US010772370B2

(12) United States Patent
Powers et al.

(10) Patent No.: US 10,772,370 B2
(45) Date of Patent: Sep. 15, 2020

(54) PARTY HAT

(71) Applicants: Michael C. Powers, Columbia, MO (US); William M. Powers, Columbia, MO (US)

(72) Inventors: Michael C. Powers, Columbia, MO (US); William M. Powers, Columbia, MO (US)

( * ) Notice: Subject to any disclaimer, the term of this patent is extended or adjusted under 35 U.S.C. 154(b) by 158 days.

(21) Appl. No.: 15/849,078

(22) Filed: Dec. 20, 2017

(65) Prior Publication Data

US 2018/0168263 A1 Jun. 21, 2018

Related U.S. Application Data

(60) Provisional application No. 62/440,220, filed on Dec. 29, 2016, provisional application No. 62/437,513, filed on Dec. 21, 2016.

(51) Int. Cl.

| | |
|---|---|
| ***A42B 1/00*** | (2006.01) |
| ***A42B 1/24*** | (2006.01) |
| ***A42B 1/20*** | (2006.01) |

(52) U.S. Cl.

CPC ..... *A42B 1/004* (2013.01); *A42B 1/242* (2013.01); *A42B 1/208* (2013.01)

(58) Field of Classification Search

CPC ..... A42B 1/004; A42B 1/242; A42B 1/244; A42B 1/248; A42B 3/0433; A42B 3/044; A42B 3/0446; A42B 3/0453

See application file for complete search history.

(56) References Cited

U.S. PATENT DOCUMENTS

| | | | | | |
|---|---|---|---|---|---|
| 2,203,028 | A * | 6/1940 | Parrillo | A42B 1/242 | 362/106 |
| 2,473,394 | A * | 6/1949 | Scott | A42B 3/0433 | 2/410 |
| 2,943,186 | A * | 6/1960 | Weiss | F21L 14/00 | 362/106 |
| 2,978,696 | A * | 4/1961 | Keller | A42B 1/242 | 340/321 |
| 4,667,274 | A * | 5/1987 | Daniel | F21L 2/00 | 2/209.13 |
| 5,479,325 | A * | 12/1995 | Chien | A42B 1/248 | 2/422 |
| 5,570,946 | A * | 11/1996 | Chien | A42B 3/044 | 362/106 |
| 5,680,718 | A * | 10/1997 | Ratcliffe | A42B 1/248 | 2/195.1 |
| 5,829,063 | A * | 11/1998 | Cheng | A42B 1/248 | 2/209.13 |
| 5,845,987 | A * | 12/1998 | Painter | A42B 1/242 | 362/206 |
| 6,007,212 | A * | 12/1999 | Chan | A42B 1/004 | 362/105 |
| 6,223,355 | B1 * | 5/2001 | Irving | A42B 1/004 | 2/171 |

(Continued)

*Primary Examiner* — Sally Haden
(74) *Attorney, Agent, or Firm* — Stinson LLP

(57) ABSTRACT

A hat for a head of a person. The hat can include an illumination system configured to illuminate a hollow interior of the hat. The hat includes light-transmissible material configured to permit light from the light source to pass from the hollow interior to an exterior of the hat to be visible from the exterior of the hat body. A noise maker party hat can include a mouth piece and a sound wave guide.

16 Claims, 12 Drawing Sheets

(56) References Cited

U.S. PATENT DOCUMENTS

| | | | | |
|---|---|---|---|---|
| 7,121,676 | B1 * | 10/2006 | Kutnyak | A42B 3/044<br>362/105 |
| 7,536,731 | B1 * | 5/2009 | Feldman | A42B 1/248<br>2/410 |
| 2006/0198122 | A1 * | 9/2006 | Senter | A42B 3/044<br>362/105 |
| 2009/0034238 | A1 * | 2/2009 | Hurwitz | A42B 3/044<br>362/106 |

* cited by examiner

PARTY HAT

CROSS-REFERENCE TO RELATED APPLICATIONS

This application claims priority to U.S. Provisional Patent Application Ser. No. 62/437,513, filed Dec. 21, 2016, and to U.S. Provisional Patent Application Ser. No. 62/440,220, filed Dec. 29, 2016, each of which is hereby incorporated by reference in its entirety.

FIELD

The present disclosure generally relates to party supplies, and more particularly to party hats.

BACKGROUND

Party supplies are commonly used to enhance party experiences of attendees at parties. For example, various types of party hats are commonly used at parties to enhance the party atmosphere. Party hats can be used at various types of parties, such as birthday parties and holiday parties. Party hats can also be used in other environments, such as sporting events, parades, and other events.

SUMMARY

In one aspect, a hat for a head of a person includes a hat body having a first end portion configured to rest on the head of the person. The hat body extends upward from the first end portion. The hat body has a hollow interior above the first end portion. An illumination system includes a light source. The light source is supported by the hat body. The light source is arranged to illuminate the hollow interior of the hat body. The hat body includes at least one section of light-transmissible material configured to permit light from the light source to pass from the hollow interior to the exterior of the hat body to be visible from the exterior of the hat body.

In another aspect, a noise maker is wearable on a head of a person. The noise maker includes a mouth piece configured for being engaged by a mouth of the person and for receiving gas from the mouth of the person. The noise maker includes a noise generating device configured to generate sound waves. The noise generating device is positioned with respect to the mouth piece to generate sound waves in response to the gas from the mouth of the person. A sound wave guide is operatively connected to the mouth piece. The sound wave guide is configured for guiding the sound waves produced by the noise generating device. The sound wave guide is configured to fit on a head of a person for wearing the noise maker as a hat. A securing device is operatively connected to the sound wave guide. The securing device is configured for securing the sound wave guide and mouth piece on the head of the person as a hat.

In another aspect, a noise maker is wearable on a head of a person as a hat. The noise maker includes a mouth piece configured for being engaged by a mouth of the person and for receiving gas from the mouth of the person. A noise generating device is configured to generate sound waves. The noise generating device is positioned with respect to the mouth piece to generate sound waves in response to the gas from the mouth of the person. A sound wave guide is operatively connected to the mouth piece. The sound wave guide has an interior defining a sound wave passage. The sound wave guide is configured for guiding the sound waves produced by the noise generating device along the sound wave passage. The sound wave guide has an inlet end defining an inlet of the sound wave passage and an outlet end defining an outlet of the sound wave passage. The outlet end is sized larger than the inlet end. The outlet end is sized to fit on the head of the person. A chin strap is operatively connected to the sound wave guide. The chin strap is configured for reception under a chin of the person when the outlet end of the sound wave guide is received on the head of the person for securing the noise maker on the head of the person as a hat.

In yet another aspect, a method of using a noise maker includes holding the noise maker in a hand of a person and blowing gas from a mouth of the person through the noise maker to generate noise. The method includes placing the noise maker on a head of the person. The method further includes securing the noise maker on the head of the person by engaging a securing device of the noise maker with the head of the person.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
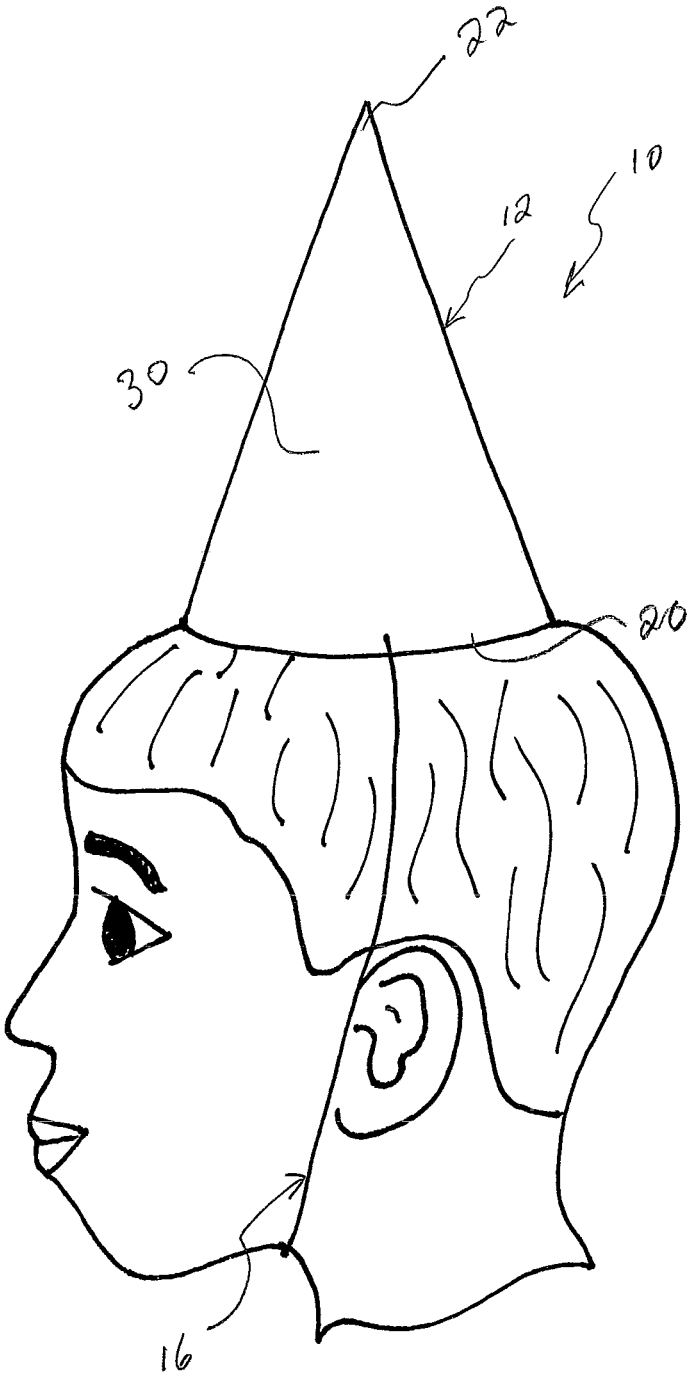
FIG. 1 is a perspective of one embodiment of a party hat of the present disclosure shown on a head of a person.
Figure 2:
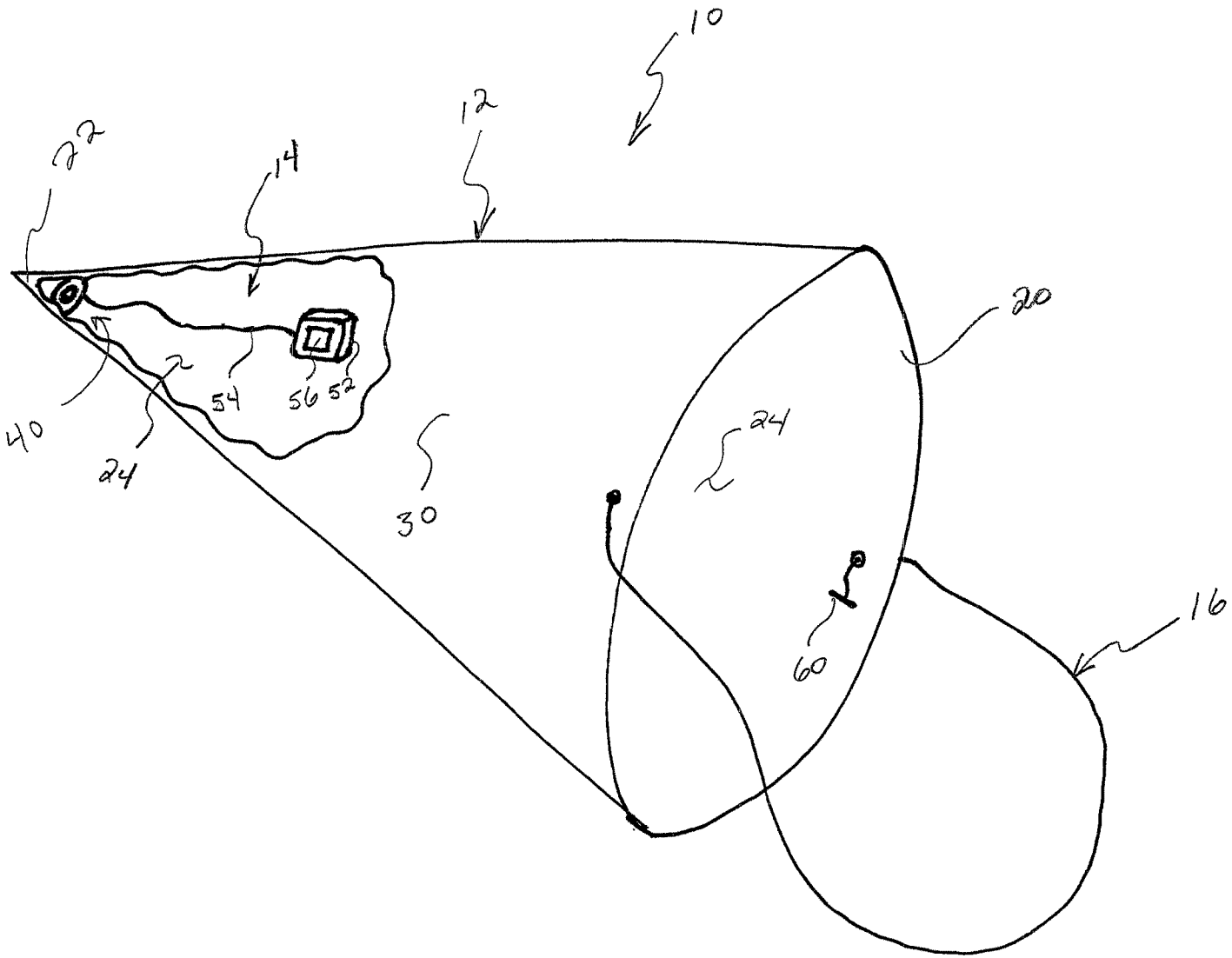
FIG. 2 is a perspective of the party hat of FIG. 1 having a portion of a hat body broken away to expose components of an illumination system.

Referring to FIGS. 1 and 2, a hat of the present disclosure is designated generally by the reference number 10. As will become apparent, the hat 10 may be referred to as a party hat and can be used for enhancing a party atmosphere of a party or other event. As shown in FIG. 1, the hat 10 is configured for wearing on a head of a person. As shown in FIG. 2, the hat 10 generally includes a hat body 12, an illumination system 14, and a securing device 16. The hat body 12 is configured for resting on the head of the wearer. The securing device 16 is optionally provided for securing the hat body 12 on the head of the wearer. As explained below, the hat body 12 can be illuminated by the illumination system 14 to enhance the visual attractiveness of the hat.

As shown in FIG. 1, the hat body 12 is configured for resting on the head of the person. The hat body includes a lower end portion 20 configured for engaging the head of the person and includes an opposite upper end portion 22 spaced from the lower end portion. In the illustrated embodiment, the hat body 12 has a generally conical shape. The lower end portion 20 is wider than the upper end portion 22, which forms a tip of the conical hat body. The lower end portion 20 has an opening for receiving the head of the person. It will be understood that in use, very little of the head of the person may be received in the opening, depending on the size of the opening and the size of the person's head. As shown in FIG. 2, the hat body 12 has a hollow interior 24 having a generally cone shape corresponding to the shape of the hat body. The hollow interior 24 extends upward from the opening at the lower end portion 20.

The hat body 12 includes a crown portion crown 30 which extends upward from the lower end portion 20 of the hat body and houses the hollow interior. In the illustrated embodiment, the lower end portion 20 of the hat body 12 is a peripheral edge of the hat body around the opening, and the crown 30 has a generally conical shape and forms most of the hat body 12. Other configurations of hat bodies can be used without departing from the scope of the present invention. For example, the hat body can be cylindrical, rounded, domed, or have another shape. Moreover, the crown may not form such a large percentage of the hat body. For example, other hat bodies can include other hat body structure, such as a brim, a bill, a side band, ear flaps, and/or other structure mounted on the crown, etc.

Desirably, the hat body 12 includes at least one section of light-transmissible material configured to permit light from the illumination system 14 to pass from the hollow interior 24 to the exterior of the hat body to be visible from the exterior of the hat body. As used herein, the term "light-transmissible" means transparent or translucent. The term "transparent" means transmitting light without appreciable scattering. Transparent materials include materials that do not absorb light in the visible range, and materials that absorb light in the visible range so long as at least some visible light is transmitted. The term "translucent" means transmitting light with appreciable scattering. Translucent materials include materials that do not absorb light in the visible range, and materials that absorb light in the visible range so long as at least some visible light is transmitted.

In the embodiment illustrated in FIGS. 1 and 2, the hat body 12 is formed of a light-transmissible material, such as a plastic material. Thus, the entire crown 30 is formed of light-transmissible material. In this embodiment, a section of light-transmissible material forms substantially all of the exterior of the crown 30. The light-transmissible material extends around the hat body 12 (around front, rear, left, and right sides of the hat body) and extends substantially the full height of the hat body. For example, the light-transmissible material can be said to extend around the crown at least 30%, at least 40%, at least 50%, at least 60%, at least 70%, at least 80%, or at least 90% of the circumference of the crown. In one example, the light-transmissible material is a single color, such as white, red, green, or blue, etc. The light-transmissible material can be translucent or transparent. In other examples, there can be multiple sections of light-transmissible material of different colors (e.g., tie-dyed, or colored sections arranged in other patterns). Multiple sections of light-transmissible material can form different areas of the exterior of the crown 30. In still other examples, the light-transmissible material can form a lesser percentage of the exterior of the crown, such as at least about 80%, at least about 70%, at least about 60%, at least about 50%, or at least about 40% of the exterior of the crown. In such cases, one or more sections of opaque material can form the remainder of the exterior of the crown.

Figure 3:
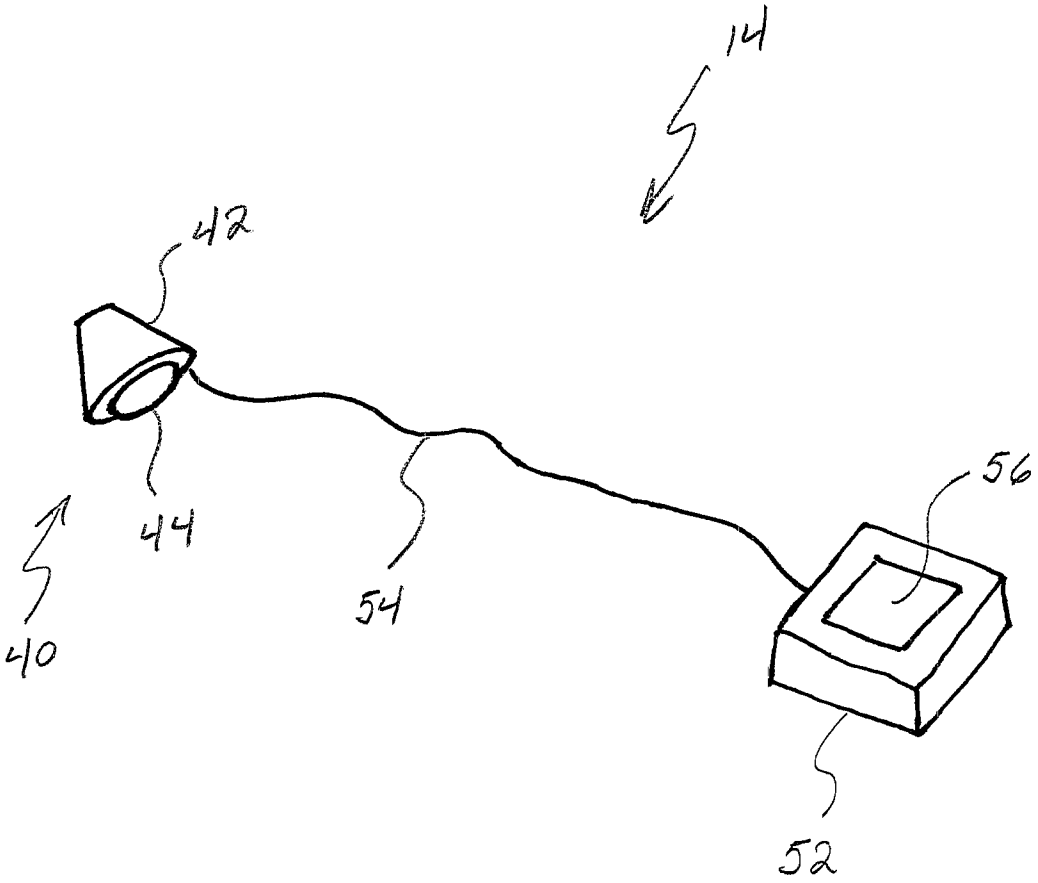
FIG. 3 is a perspective of the illumination system of FIG. 2.

Referring to FIGS. 2 and 3, the illumination system 14 includes a light source 40. The light source 40 is provided for illuminating the hollow interior 24 of the hat body 12 such that light from the hollow interior can be seen from the exterior of the hat body through the light-transmissible material. The light source 40 can include one or more light emitting elements, such as LEDs. In the illustrated embodiment, the light source includes a light source housing 42 and a lens 44 that together house the light emitting elements. The light source housing 42 is mounted (e.g., adhered, fastened, etc.) adjacent the top of the crown 30 and has a tapering side wall for corresponding to the tapering inside surface of the upper end of the crown adjacent the tip of the cone shape. The light source 40 being adjacent the top of the crown 30 permits the light source to illuminate a vast majority of the hollow interior 24 of the crown. A power source (e.g., one or more batteries) is housed in a power source housing 52 spaced from the light source housing 42. The power source housing 52 is mounted on the hat body 12 closer to the lower end 20 portion of the hat body. Electrical wiring 54 electrically connects the power source and the light emitting elements. A switch 56 on the power source housing 52 is provided for selectively turning the light source 40 on and off. In the illustrated embodiment, the switch 56 is provided in the form of a button (e.g., a "clickie" button) that can be pressed a first time to turn the light source 40 on and pressed a second time to turn the light source off.

The illumination system 14 can be configured to illuminate the interior of the crown 30 in various ways. For example, the illumination system 14 can have an illumination system controller housed in the light source housing 42 or the power source housing 52 programmed to control the light source 40 to emit different colors one after another from the light source. For example white, red, blue, and green light emitting elements can be provided in the light source housing 42, and the illumination system controller can be programmed to energize the light emitting elements one at a time in succession. The illumination system controller can also be programmed to control the light source 40 to emit flashing light from one or more of the light emitting elements. These and other modes of the light source 40 may be cycled through by pressing the button 56 multiple times. Accordingly, when the light source 40 is turned on, light from the light source illuminates at least some of the hollow interior and is visible from the exterior of the hat body through the light-transmissible material. Thus, the hat has a desirable visual appearance.

Illumination systems having other configurations can be used without departing from the scope of the present invention. For example, the power source and switch may be housed in the light source housing instead of providing the separate power source housing. In such an example, the lens of the light source could be pushable as a button to turn the light source on and off.

The securing device 16 is configured for securing the hat body on the head of the person. In the illustrated embodiment, the securing device 16 is configured for reception under a chin of the person. More specifically, the securing device is provided in the form of a chin strap 16. The chin strap 16 has opposite end portions connected to the hat body 12. The opposite end portions are connected to opposing sides of the hat body 12 at the lower end portion 20 of the hat body. In one example, the chin strap 16 comprises an elastic member sized for stretching to fit under the chin of the person. The chin strap 16 can be connected to the hat body 12 in any suitable manner, such as by stapling, tying, adhering, etc. In the illustrated embodiment, the end portions of the chin strap include transverse retainers 60 that once inserted through a hole in the hat body 12 obstruct removal from the hole. Other configurations and arrangements of securing devices can be used without departing from the scope of the present invention. Moreover, the securing device may be omitted.

Figure 4:
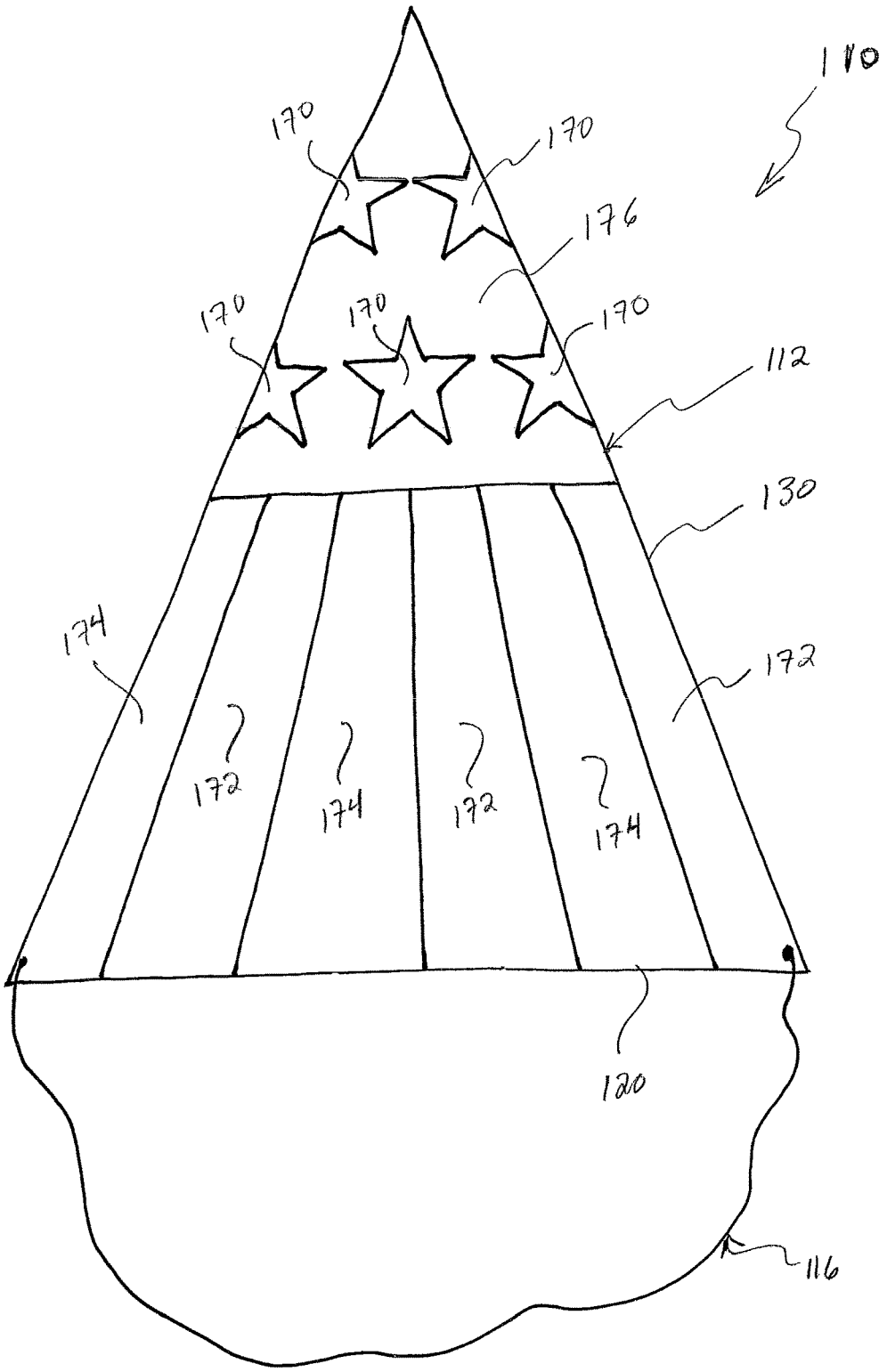
FIG. 4 is a front elevation of another embodiment of a party hat of the present disclosure.

Referring now to FIG. 4, another embodiment of a hat of the present disclosure is indicated generally by the reference number 110. The hat 110 has essentially the same construction as the hat 10 discussed above, except as explained hereafter. For example, the hat 110 has a hat body 112 including a lower end portion 120 configured for resting on a person's head, and includes a crown 130 having a generally conical shape extending upward from the lower end portion. The hat 110 also includes a securing device 116. Although not shown, an illumination system like the illumination system 14 discussed above is provided in the hollow interior of the hat body. In this embodiment, the hat 110 has an American flag theme. The crown 130 includes a plurality of sections 170 of light-transmissible material forming stars on an upper portion of the crown, and includes a plurality of sections 172, 174 of light-transmissible material forming side-by-side stripes on a lower portion of the crown. The stars can be formed of separate white colored translucent sections of light-transmissible material. A section 176 of blue colored translucent light-transmissible material separates the stars from each other. The stripes are formed by separate sections 172, 174 of white and red translucent light-transmissible material arranged in alternating fashion. The stars and stripes pattern extends around the hat body 112 across the front, rear, left, and right sides of the hat body. When the light source is on, illuminating the hollow interior, the various sections 170, 172, 174, 176 of light-transmissible material are illuminated, and provide a desirable visual appearance to the hat. The hat body 112 can be manufactured by forming a sheet having the stars and stripes pattern and rolling the sheet into the cone shape, or the cone shape can be molded and have the stars and stripes pattern applied to it.

Figure 5:
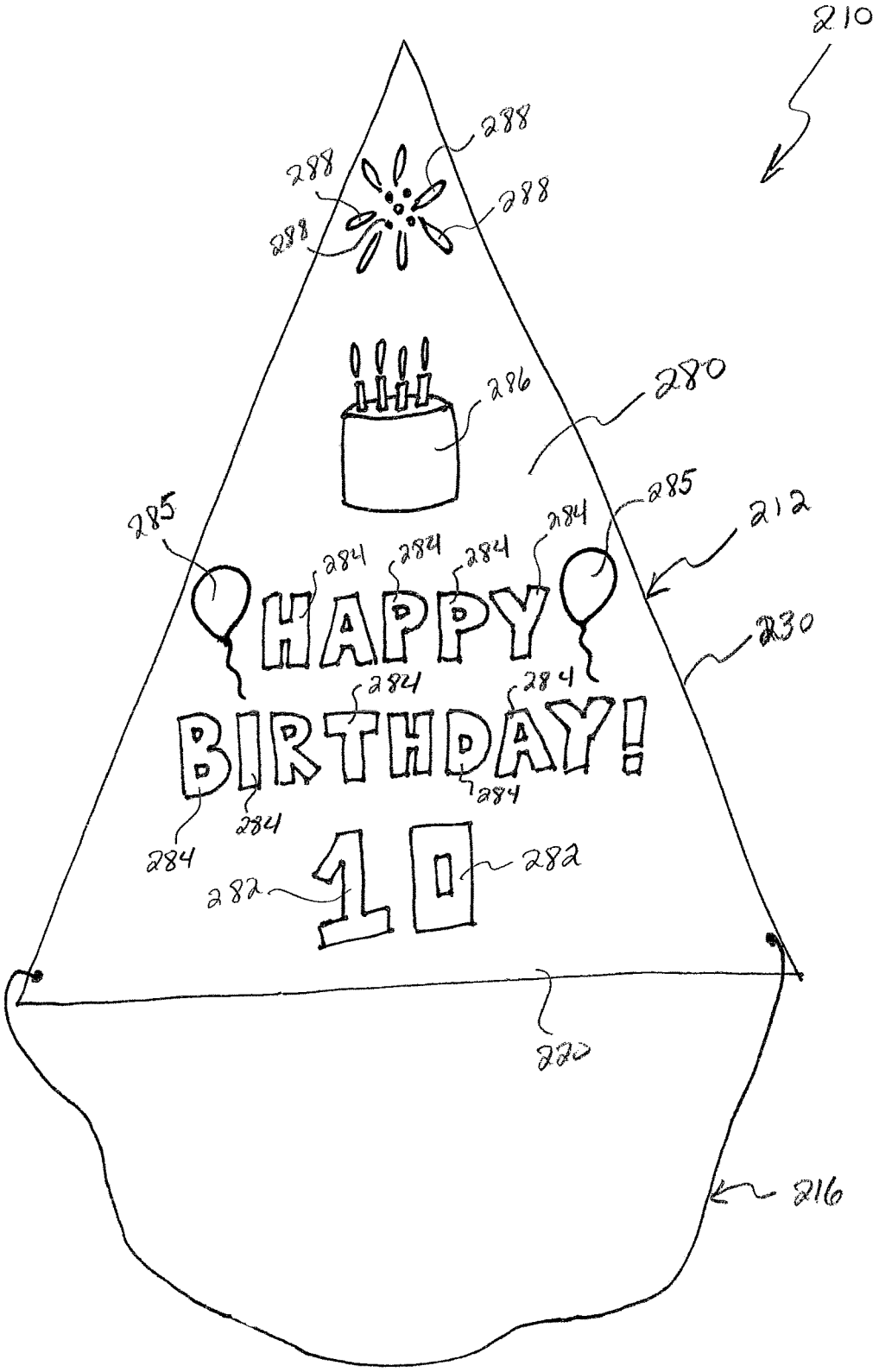
FIG. 5 is a front elevation of another embodiment of a party hat of the present disclosure.
Figure 6:
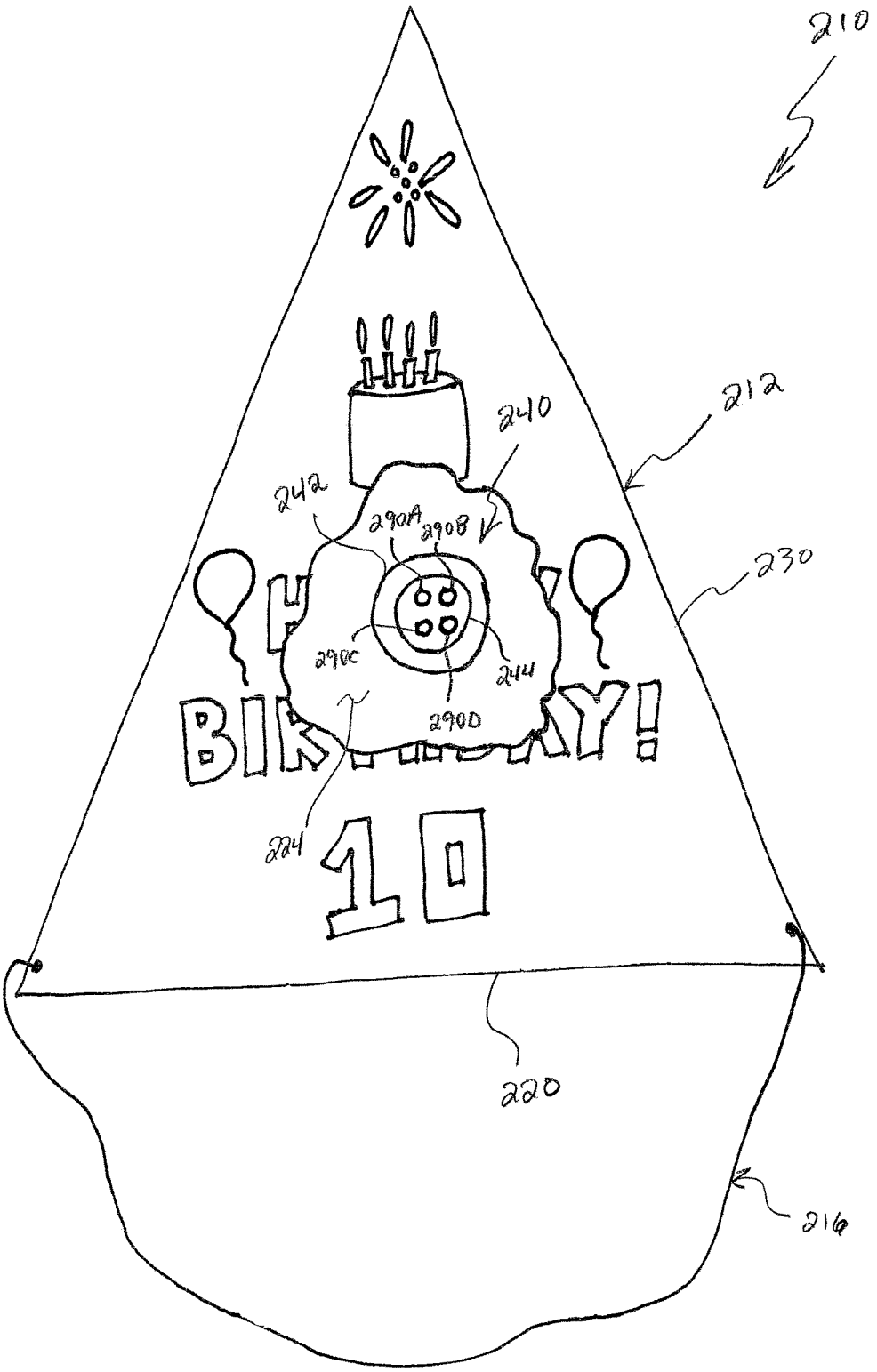
FIG. 6 is a front elevation of the party hat of FIG. 5 having a portion of a hat body broken away to show an illumination system.

Referring to FIGS. 5 and 6, another embodiment of a hat of the present disclosure is indicated generally by the reference number 210. The hat 210 has essentially the same construction as the hats 10, 110 discussed above, except as explained hereafter. For example, the hat 210 has a hat body 212 including a lower end portion 220 configured for resting on a person's head, and includes a crown 230 having a generally conical shape extending upward from the lower end portion. The hat 210 has a securing device 216. In this embodiment, the hat 210 has a birthday theme. The majority of the exterior of the crown 230 is formed by a section 280 of opaque material. The opaque material serves as a background for multiple sections of light-transmissible material. For example, a first set of sections 282 of light-transmissible material form the numbers "1" and "0" and are arranged side by side to form the number "10." This could indicate the age of the person having the birthday. Several additional sections 284 of light-transmissible material form letters arranged in rows forming the words "HAPPY" and "BIRTHDAY." Additional sections 285, 286, 288 of light-transmissible material form images such as balloons, a cake (birthday cake), and a firework (exploded). The sections of light-transmissible material 282, 284, 285, 286, 288 can be transparent or translucent and can all be the same color or can be different colors. For example, the words may be blue, the number may be red, the balloons may be yellow, and the cake and firework may be white. In this embodiment, the section 280 of opaque material borders and surrounds all of the sections of light-transmissible material. The section of opaque material 280 forms the entire rear side of the hat body 212 and thus the majority of the exterior of the hat body. The hat body 212 can be manufactured in various ways, such as those described above. As another example, a cone of opaque material can be formed having openings corresponding to the shapes of the numbers, letters, and images therein, and film of light-transmissible material can be secured to the cone of opaque material for forming the sections 282, 284, 285, 286, 288 of light-transmissible material having those shapes.

Referring to FIG. 6, the illumination system 214 of this embodiment of the hat 210 has a different configuration. The illumination system 214 includes a light source 240 mounted in a different location. More specifically, the light source housing 242 is mounted on an inside rear surface of the hat body 212 opposite and across the hollow interior 224 from the plurality of sections of light-transmissible material. In this embodiment, the light source housing 242 houses not only the light emitting elements 290A-290D, but also the illumination system controller, the power source, and the switch. The lens 244 of the light source can be pressed like a button to actuate the switch to cycle between an off state and several different on states. Four light emitting elements 290A-290D (e.g., LEDs) are provided. In one example, the light emitting elements are configured for emitting different colors, such as red, blue, green, and white. In another example, the light emitting elements are the same color.

The illumination system 214 can be configured to illuminate the interior of the crown in various ways. For example, the illumination system controller can be programmed to control the light source 240 to emit different colors one after another from the light source. For example the illumination system controller can be programmed to energize the red, blue, green, and white light emitting elements 290A-290D one at a time in succession. The illumination system controller can also be programmed to control the light source 240 to emit flashing light from one or more of the light emitting elements 290A-290D. These and other operating modes of the light source 240 may be cycled through by pressing the lens 244 of the light source as a button multiple times. Accordingly, when the light source 240 is turned on, light from the light source illuminates some or all of the hollow interior 224 and is visible from the exterior of the hat body 212 through the light-transmissible material. Thus, the hat has a desirable visual appearance.

Figure 7:
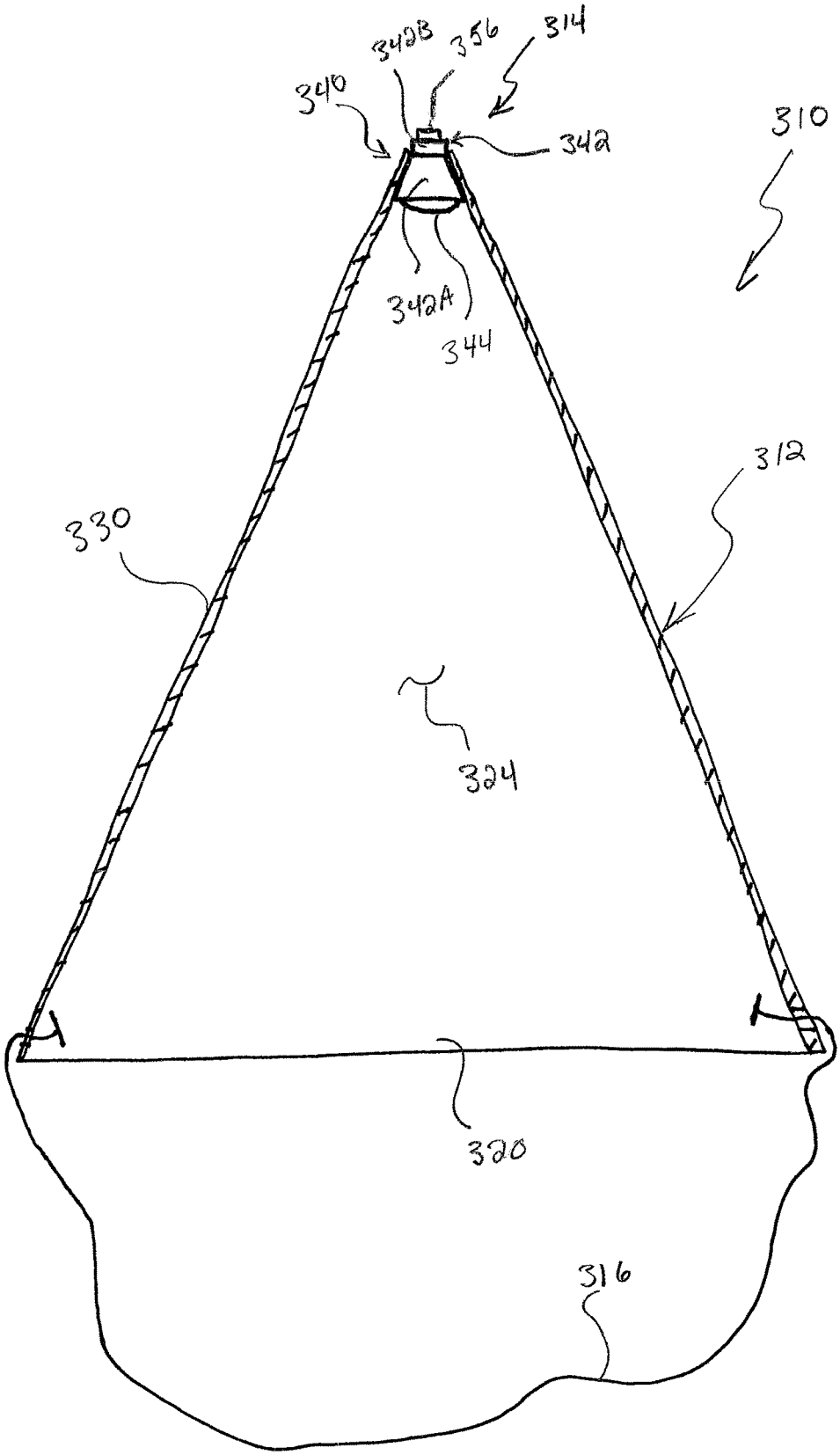
FIG. 7 is a partial section of another embodiment of a party hat of the present disclosure, a hat body of the hat being shown in section and an illumination system and a securing device of the hat not being shown in section.

Referring to FIG. 7, another embodiment of a hat of the present disclosure is indicated generally by the reference number 310. The hat 310 has essentially the same construction as the hats 10, 110, 210 discussed above, except as explained hereafter. For example, the hat 310 has a hat body 312 including a lower end portion 320 configured for resting on a person's head, and includes a crown 330 having a generally conical shape extending upward from the lower end portion. The hat 310 has a hollow interior 324 and has a securing device 316. The hat body 312 is shown in section to show the hollow interior 324 and to fully show the illumination system 314. It will be understood the hat body 312 can have any suitable construction, such as any of the constructions disclosed above. For example, the hat body can include one or more sections of light transmissible material.

In this embodiment, the illumination system 314, and in particular the light source 340, has a different configuration. The light source 340 is mounted on the hat body 312 adjacent an upper end of the crown 330. The light source housing 342 houses not only the light emitting elements (e.g., one or more light emitting elements), but also the illumination system controller, the power source, and the switch 356. In the illustrated embodiment, the light source housing 342 and the lens 344 together house the light emitting elements. The light source housing 342 is mounted (e.g., adhered, fastened, etc.) adjacent the top of the crown 330 and has a tapering side wall for corresponding to the tapering inside surface of the upper end of the crown. The hat body 312 has an opening at the upper end of the hat body. The light source housing 342 is received in the opening for mounting the light source on the hat body 312. For example, in manufacture, the light source 340 can be inserted through the larger open bottom end of the hat body 312 and moved through the hollow interior 324 of the hat body until the light source housing 342 becomes seated in the upper end of the hat body and protrudes from the upper opening in the hat body. The light source housing 342 has a lower housing portion 342A that has the shape of a truncated cone for corresponding to the interior surface of the hat body 312. The light source housing 342 has an upper housing portion 342B having a cylindrical shape that is sized to fit in the opening in the upper end of the hat body 312. For example, an adhesive can be used to secure the light source housing 342 in position at the upper end of the hat body 312 by adhering the lower and/or upper housing portions 342A, 342B to the hat body. In an alternative example, all or part of the light source body can be formed as one piece with the hat body or a component thereof. The light source 340 being adjacent the top of the crown 330 permits the light source to illuminate a vast majority of the hollow interior 324 of the crown.

The switch 356 is provided in the form of a button on a top of the light source housing 342. The button 356 of the light source 340 can be pressed to actuate the button to cycle between an off state and several different on states. For example, four light emitting elements (e.g., LEDs) can be provided as in the light source 240 described above. In one example, the light emitting elements are configured for emitting different colors, such as red, blue, green, and white. In another example, the light emitting elements are the same color. The illumination system 314 can be configured to illuminate the interior 324 of the crown 330 in various ways. For example, the illumination system controller can be programmed to control the light source 340 to emit different colors one after another from the light source 340. For example the illumination system controller can be programmed to energize the red, blue, green, and white light emitting elements one at a time in succession. The illumination system controller can also be programmed to control the light source 240 to emit flashing light (e.g., strobe) from one or more of the light emitting elements. These and other operating modes of the light source 340 may be cycled through by pressing the button 356 of the light source 340 multiple times. Accordingly, when the light source 340 is turned on, light from the light source illuminates some or all of the hollow interior 324 and is visible from the exterior of the hat body 312 through the one or more sections of light-transmissible material. Thus, the hat 310 has a desirable visual appearance.

Figure 7A:
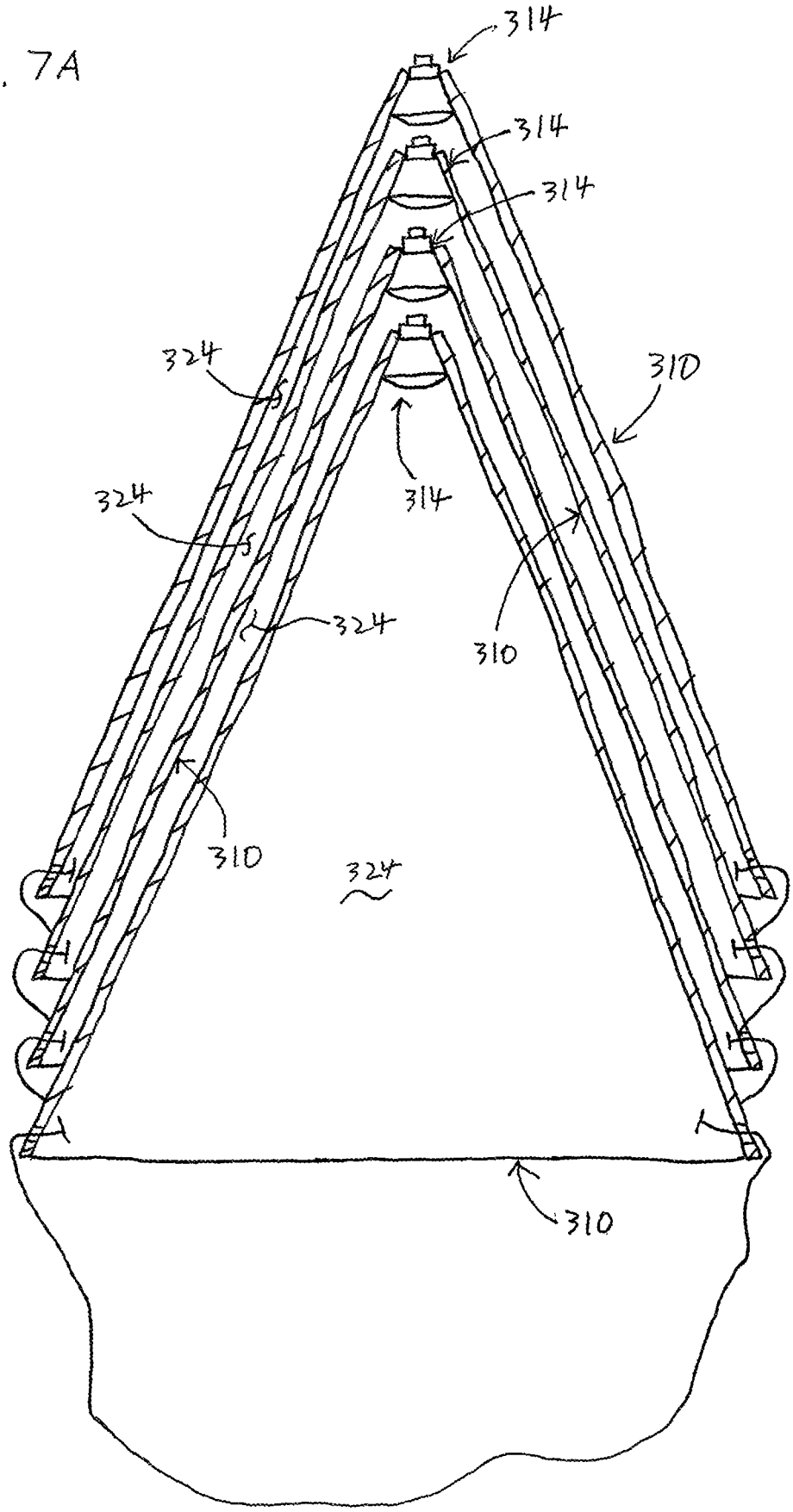
FIG. 7A is a partial section of multiple party hats of FIG. 7 nested together.

It will be understood that multiple hats 310 may be stored together by stacking or nesting the hats 310 one on top of the other, as shown in FIG. 7A. The lower housing portion 342A and/or lens 344 can be suitably configured to receive the button 356 of a nested hat such that the button of the nested hat is not pressed by the lower housing portion 342A and/or lens 344. For example, the lower housing portion 342A and/or lens 344 can be configured to rest on the upper housing portion 342B of the nested hat and not rest on the button 356. Alternatively, the button 356 can be flush with or recessed in the upper housing portion 342B such that the button will not be pressed when nested in another hat. Accordingly, the light source 340 will not be inadvertently turned on while the hat is in storage.

Figure 8:
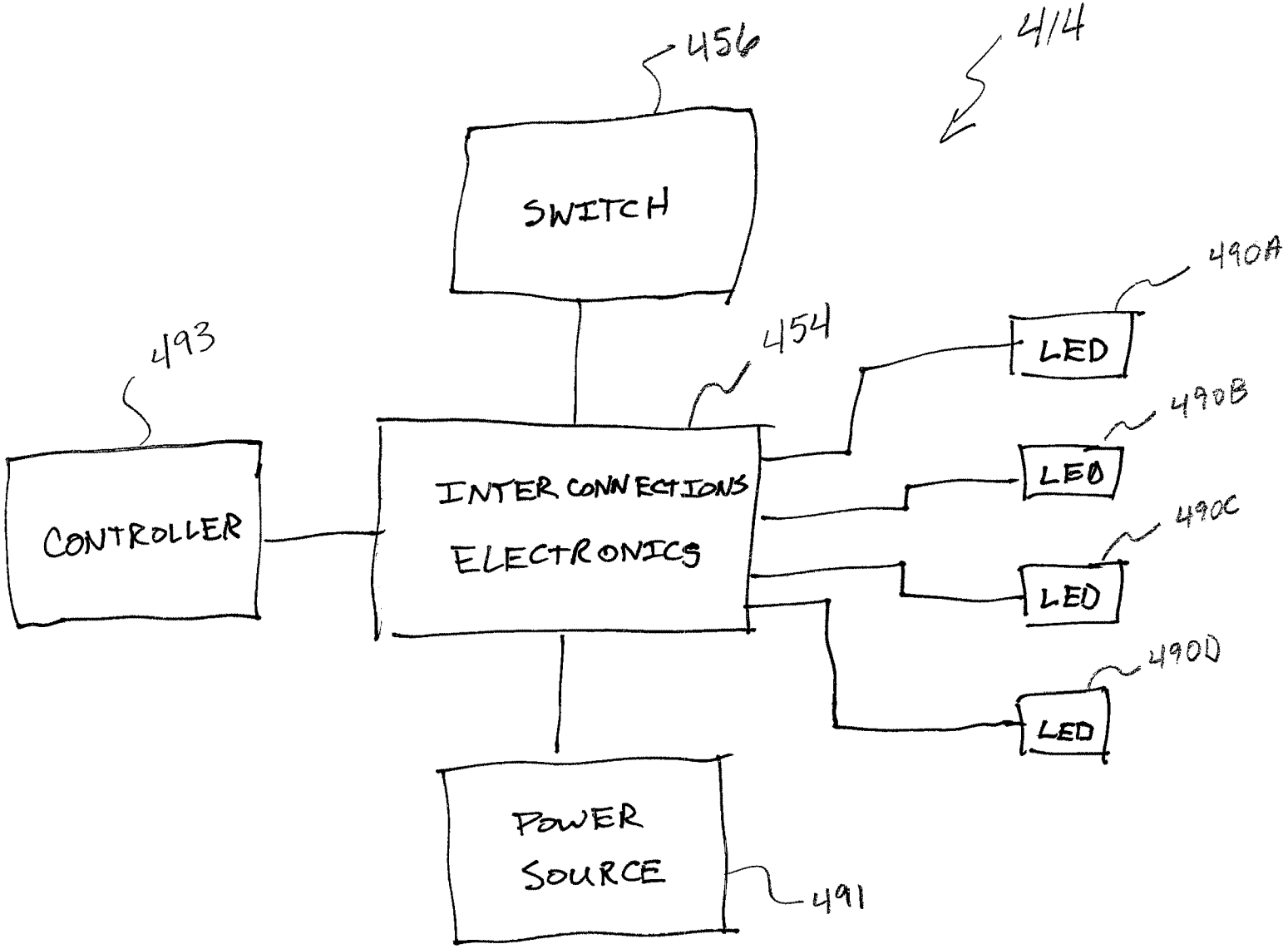
FIG. 8 is a schematic of an illumination system of the present disclosure.

FIG. 8 shows a schematic of an illumination system 414 that can be used in any of the hats 10, 110, 210, 310 disclosed herein. The illumination system 414 includes four light emitting elements 490A-490B, such as LEDs of the same or different colors. A power source 491 (e.g., one or more batteries) provides power to the illumination system 414. The switch 456 permits the user to turn the light emitting elements 490A-490B on and off and operate the light emitting elements in different modes, such as described above. The switch 456 can be a button or any other suitable switch. The illumination system controller 493 is configured for controlling operation of the light emitting elements 490A-490B responsive to user input via the switch 456. The illumination system controller 493 stores and executes programmed modes of operation such as those described above. Interconnections electronics 454 (e.g., electrical wiring, electrical contacts, and/or printed circuit boards, etc.) electrically connect the components of the illumination system 414.

Figure 9:
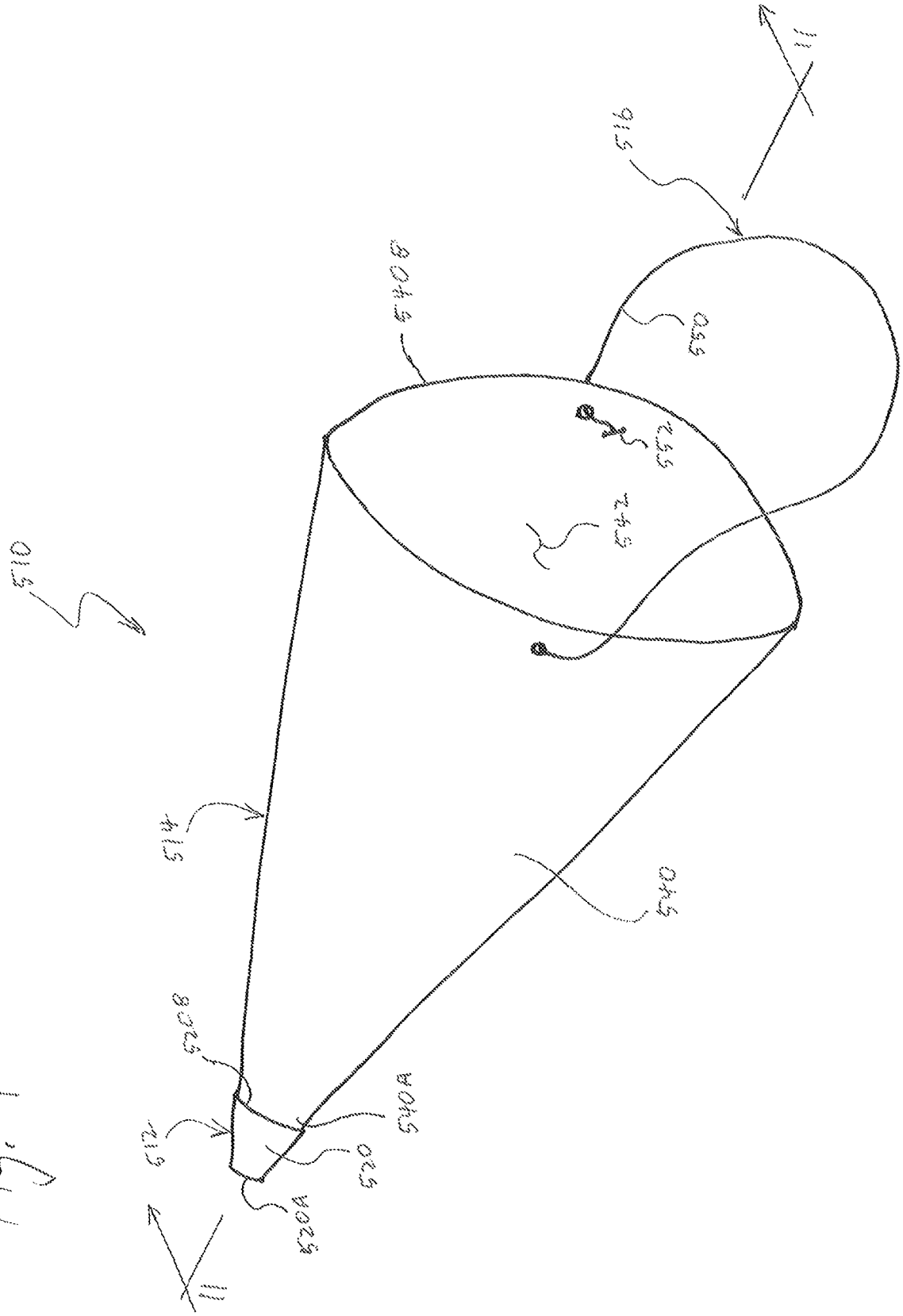
FIG. 9 is a perspective of another embodiment of a party hat of the present disclosure, the party hat being a noise maker party hat.
Figure 10:
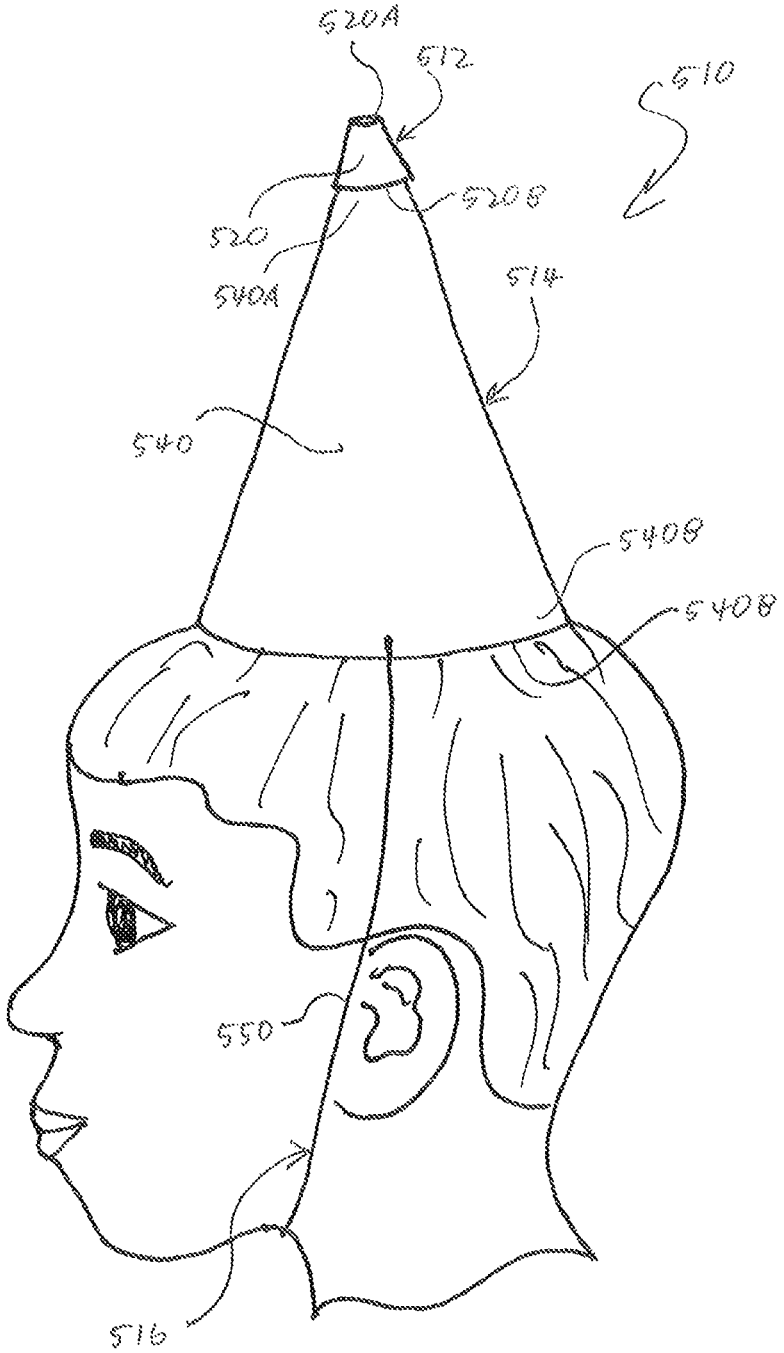
FIG. 10 is a perspective of the noise maker party hat of FIG. 9 shown on a head of a person.
Figure 11:
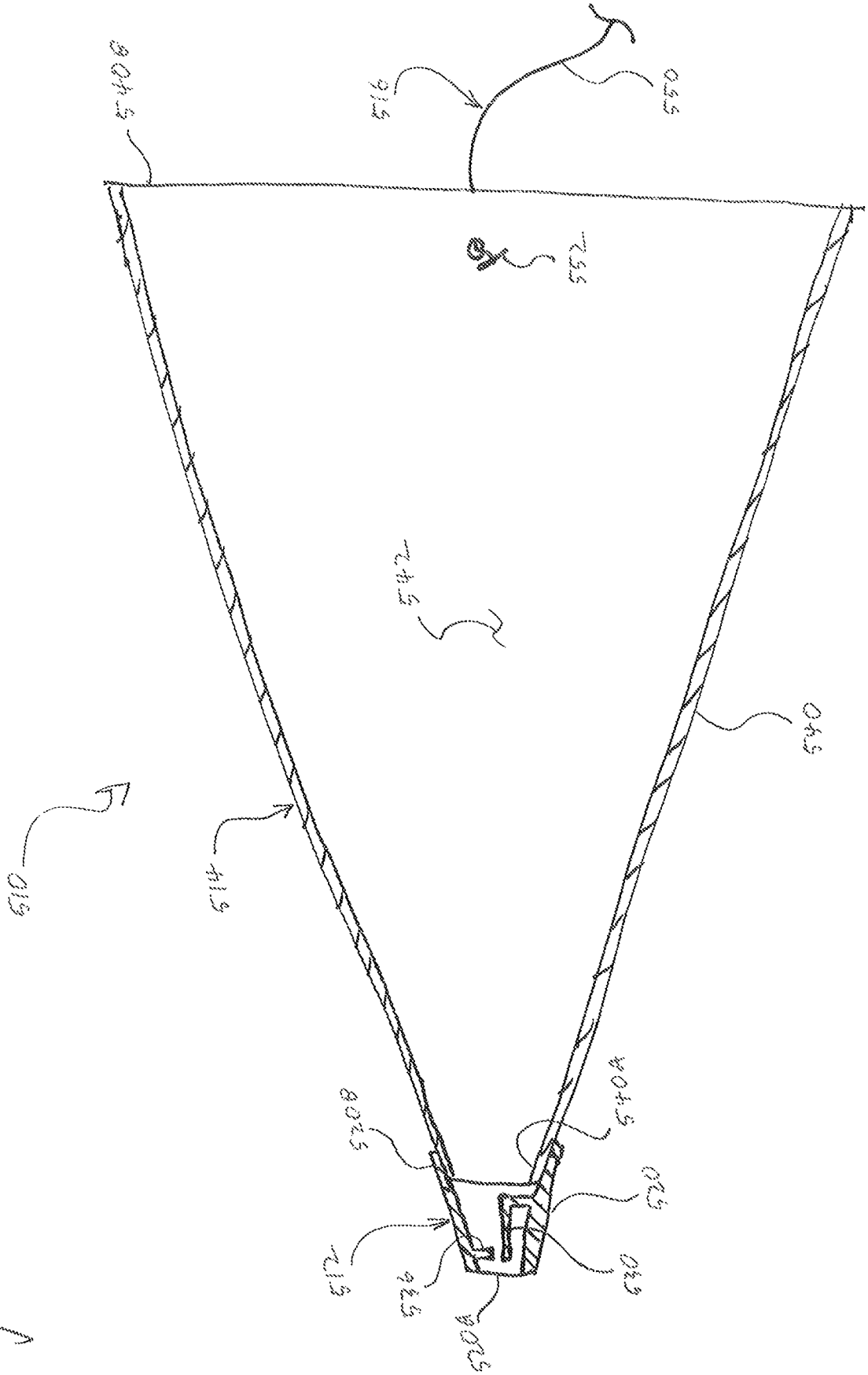
FIG. 11 is a section of the noise maker party hat taken in a plane including line 11-11 of FIG. 9.

Referring to FIGS. 9-11, another embodiment of a hat of the present disclosure is indicated generally by the reference number 510. The hat 510 is a noise maker party hat. As will become apparent, the noise maker party hat 510 can be used for enhancing a party atmosphere of a party. The noise maker party hat can be used as both a noise maker and as a party hat and can be referred to as a combination noise maker party hat. However, the noise maker party hat 510 will be referred to hereafter as a noise maker with the understanding that the noise maker is configured for wearing on the head of a person as a hat when not being used as a noise maker.

As shown in FIG. 9, the noise maker 510 generally includes a mouth piece 512, a sound wave guide 514, and a securing device 516 for securing the noise maker on a head of a human. The noise maker 510 has a generally conical shape, with the mouth piece 512 defining a relatively smaller end of the noise maker having a tip, and the sound wave guide defining an opposite relatively larger, open end of the noise maker larger than the tip. As explained in further detail below, the securing device 516 is configured for securing the sound wave guide 514 on the head of a person with the relatively large open end on the top of the person's head, as illustrated in FIG. 10.

Referring to FIG. 11, the mouth piece 512 is configured for being engaged by a mouth of the person and for receiving gas from the mouth of the person when the mouth is engaging the mouth piece. The mouth piece includes a housing 520 including an inlet end 520A having a gas inlet and including an outlet end 520B having a gas outlet. The inlet end 520A defines the tip of the smaller end of the noise maker 510 and is positioned at a top of the noise maker when worn as a hat, as shown in FIG. 10. To make noise with the noise maker, the person applies their mouth to the mouth piece 512 and blows gas into the inlet of the mouth piece.

Still referring to FIG. 11, the noise maker includes a reed 530 (broadly, "noise generating device") configured to generate sound waves. The reed 530 is positioned in the interior of the mouth piece 512 such that gas from the mouth of the person flows over the reed to generate sound waves. More specifically, the reed 530 is positioned and arranged to vibrate as the gas flows over the reed, and the vibration of the reed produces sound waves. In the illustrated embodiment, the reed 530 is cantilevered and has a free end pointing toward the mouth piece inlet. The mouth piece 512 includes a wall 536 protruding into its interior that directs gas flow in a manner that facilitates vibration of the reed 530.

The mouth piece 512 and reed 530 can be made of plastic or any other suitable material. In the illustrated embodiment, the reed 530 is formed as one piece with the mouth piece 512, such as by injection molding. Mouth pieces and sound generating devices having other configurations and arrangements can be used without departing from the scope of the present invention.

The sound wave guide 514 is configured for guiding the sound waves produced by the reed 530. The sound wave guide 514 includes a body 540 having an inlet end 540A and an outlet end 540B. As shown in FIG. 3, the inlet end 540A has an inlet, and the outlet end 540B has an outlet. The body defines a sound wave passage 542 extending between the inlet and outlet. The sound wave passage 542 is arranged for receiving the sound waves produced by the reed 530. The outlet end 540B of the sound wave guide 514 defines the larger open end of the noise maker 510. In the illustrated embodiment, the body 540 of the sound wave guide 514 has a generally conical shape. The inlet end 540A of the sound wave guide 514 is secured to the mouth piece 512, and the outlet end 540B is opposite the mouth piece. The sound wave guide 514 can be operatively connected to the mouth piece 512 in various ways, such as by adhering or mechanically fastening the inlet end 540A of the sound wave guide to the mouth piece. Alternatively, the sound wave guide 514 can be operatively connected to the mouth piece 512 by forming the sound wave guide and mouth piece together as one piece. In the illustrated embodiment, the inlet end 540A of the sound wave guide 514 is adhered to the inside of the outlet end 520B of the mouth piece 512. The sound wave guide 514 can be formed of any suitable material, such as paper, cardboard, and/or plastic, etc. Other configurations of sound wave guides and arrangements of the sound wave guide with respect to the mouth piece and reed can be used without departing form the scope of the present invention.

The sound wave guide 514 is configured to fit on a head of a person for wearing the noise maker 510 as a hat. Desirably, the outlet end 540B of the sound wave guide is sized to fit on the head of the person. For example, the opening or outlet at the outlet end 540B is at least 3 inches wide, at least 4 inches wide, at least 5 inches wide, or at least 6 inches wide. In the illustrated embodiment, the outlet end 540B defines a round opening and the width corresponds to the diameter of the round opening. Other configurations, such as other dimensions, and outlets having other constructions can be used without departing from the scope of the present invention.

The securing device 516 is configured for securing the sound wave guide 514 and mouth piece 512 on the head of the person as a hat. In the illustrated embodiment, the securing device 516 is configured for reception under a chin of the person. More specifically, the securing device 516 is provided in the form of a chin strap. The chin strap 516 has opposite end portions secured to the sound wave guide. The opposite end portions are operatively connected to opposing sides of the sound wave guide adjacent the outlet 540B. The chin strap 516 can be secured to the wave guide 514 in any suitable manner, such as by stapling, tying, adhering, etc. Alternatively the securing device 516 can be operatively connected to the sound wave guide 514 by forming the securing device and sound wave guide together as one piece. In the illustrated embodiment, the end portions of the chin strap 516 include transverse retainers 552 (FIGS. 9 and 11) that, once inserted through a hole in the sound wave guide, obstruct removal from the hole. In one example, the chin strap includes an elastic member 550 sized for stretching to fit under the chin of the person. The resilient elasticity of the elastic member 550 can securely hold the wave guide in position on the head of the person. Other configurations and arrangements of securing devices can be used without departing from the scope of the present invention. For example, the securing device need not be configured to extend under the person's chin. Moreover, the securing device may include multiple securing members, such as hair clips, head clamps, etc.

In use, a person can choose to use the noise maker 510 as a noise maker or to wear the noise maker as a hat. While the noise maker is used as a noise maker, the wave guide 514 or mouth piece 512 may be held in the hand of the person, and they can blow gas through the mouth piece to direct sound waves in the direction in which the sound wave guide is pointing. When the noise maker 510 is worn as a hat, as shown in FIG. 9, the sound wave guide 514 is seated on the head of the person, the mouth piece 512 is positioned at the top of the noise maker 510, and the securing device 516 secures the sound wave guide on the person's head.

It will be appreciated that hats having other designs and/or other themes can be constructed according to the principles of the present disclosure. For example, hats themed for various holidays, party occasions, and other events can be provided using principles disclosed herein.

Having described the embodiments of hats in detail, it will be apparent that modifications and variations are possible without departing from the scope of the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A hat for a head of a person, the hat comprising:

a cone-shaped hat body having opposite upper and lower end portions, the lower end portion being wider than the upper end portion, the upper end portion forming a tip of the cone-shaped hat body, the lower end portion configured to rest on the head of the person, the hat body extending upward from the lower end portion to the upper end portion, the hat body having a cone-shaped hollow interior above the lower end portion, the lower end portion having an opening for receiving a portion of the head of the person, an illumination system including a light source, the light source being supported by the hat body, the light source being arranged to illuminate the hollow interior of the hat body, the light source mounted in the hollow interior at the tip and oriented to face downward toward the lower end portion to emit light toward the lower end portion to illuminate the hollow interior, at least a portion of the hat body being formed of a light-transmissible material configured to permit light from the light source to pass from the hollow interior to the exterior of the hat body to be visible from the exterior of the hat body, wherein the light source is in open communication with the opening, and the light source is arranged with respect to the opening, such that the light emitted by the light source reaches the opening and illuminates a majority of the portion of the head of the person when the hat is on the head of the person and the light source illuminates the hollow interior.

2. A hat as set forth in claim 1 wherein the hat body includes a crown extending upward from the lower end portion of the hat body, the crown housing said hollow interior, the crown including the at least one section of light-transmissible material.

3. A hat as set forth in claim 2 wherein the hollow interior of the crown extends upward from the opening of the lower end portion to the light source.

4. A hat as set forth in claim 2 wherein the crown tapers from the lower end portion to the upper end portion.

5. A hat as set forth in claim 1 wherein the light source includes multiple light emitting elements.

6. A hat as set forth in claim 5 wherein the multiple light emitting elements comprise first and second light emitting elements, the first light emitting element being configured to emit a first color and the second light emitting element being configured to emit a second color different than the first color.

7. A hat as set forth in claim 1 wherein the illumination system includes a switch at the upper end portion, the switch configured to turn the light source on.

8. A hat as set forth in claim 7 wherein the switch is disposed on or outward of an exterior surface of the hat body.

9. A hat as set forth in claim 1 wherein the hat body includes a forward-facing portion configured to be disposed over a front portion of the head of the person when the hat is worn on the head of the person and a rearward-facing portion configured to be disposed over a rear portion of the head of the person when the hat is worn on the head of the person, the light source configured to illuminate the forward- and rearward-facing portions of the hat body such that the illuminated forward-facing portion is visible in front of the hat and the illuminated rearward-facing portion is visible behind the hat.

10. A hat as set forth in claim 1 wherein the hat is a first hat and further comprising a second hat, the hollow interior is of the first hat being sized and shaped to receive the second hat to arrange the first and second hats in a nested configuration in which the second hat is nested in the hollow interior of the first hat, the second hat including a second hat body and a second illumination system including a second light source, the second light source being supported by the second hat body, the second light source positioned adjacent to an upper end portion of the second hat body and oriented to face downward toward a lower end portion of the second hat body to emit light toward the lower end portion of the second hat body to illuminate a hollow interior of the second hat body, the second hat body having a cone shape.

11. A hat as set forth in claim 10 wherein the second hat is nested in the hollow interior of the first hat such that the upper end portion of the first hat body is adjacent the upper end portion of the second hat body.

12. A hat as set forth in claim 1, wherein the lower end portion includes a lower edge extending around the opening for receiving the head of the person, the lower edge defining forward and rearward sections.

13. A hat assembly comprising:

a first hat comprising:

a cone-shaped first hat body having opposite first upper and first lower end portions, the first lower end portion being wider than the first upper end portion, the first upper end portion forming a first tip of the cone-shaped first hat body, the first lower end portion configured to rest on the head of the person, the first hat body extending upward from the first lower end portion to the first upper end portion, the first hat body having a cone-shaped first hollow interior above the first lower end portion, the lower end portion having an opening for receiving a portion of the head of the person, a first illumination system including a first light source, the first light source being supported by the first hat body, the first light source being arranged to illuminate the first hollow interior of the first hat body, the first light source mounted in the first hollow interior at the first tip and oriented to face downward toward the first lower end portion to emit light toward the first lower end portion to illuminate the first hollow interior, at least a portion of the first hat body being formed of a first light-transmissible material configured to permit light from the first light source to pass from the first hollow interior to an exterior of the first hat body to be visible from the exterior of the first hat body, wherein the first light source is in open communication with the opening, and the first light source is arranged with respect to the opening, such that the light emitted by the first light source reaches the opening and illuminates a majority of the portion of the head of the person when the first hat is on the head of the person and the first light source illuminates the first hollow interior;

a second hat comprising:

a second hat body having opposite second upper and second lower end portions, the second lower end portion configured to rest on the head of the person, the second hat body extending upward from the second lower end portion to the second upper end portion, the second hat body having a second hollow interior above the second lower end portion, a second illumination system including a second light source, the second light source being supported by the second hat body, the second light source being arranged to illuminate the second hollow interior of the second hat body, the second light source positioned adjacent to the second upper end portion and oriented to face downward toward the second lower end portion to emit light toward the second lower end portion to illuminate the second hollow interior, the second hat body including at least one second section of light-transmissible material configured to permit light from the second light source to pass from the second hollow interior to the exterior of the second hat body to be visible from the exterior of the second hat body, wherein the first and second hats are in a nested configuration such that the second hat is nested in the first hollow interior of the first hat;

wherein the second hat has a height extending between the first upper and first lower end portions, at least a majority of the height of the second hat being disposed within the first hollow interior of the first hat.

14. The hat assembly as set forth in claim 13 further comprising:

a third hat comprising:

a third hat body having opposite third upper and third lower end portions, the third lower end portion configured to rest on the head of the person, the third hat body extending upward from the third lower end portion to the third upper end portion, the third hat body having a third hollow interior above the third lower end portion, a third illumination system including a third light source, the third light source being supported by the third hat body, the third light source being arranged to illuminate the third hollow interior of the third hat body, the third light source positioned adjacent to the third upper end portion and oriented to face downward toward the third lower end portion to emit light toward the third lower end portion to illuminate the third hollow interior, the third hat body including at least one third section of light-transmissible material configured to permit light from the third light source to pass from the third hollow interior to the exterior of the third hat body to be visible from the exterior of the third hat body, and a fourth hat comprising:

a fourth hat body having opposite fourth upper and fourth lower end portions, the fourth lower end portion configured to rest on the head of the person, the fourth hat body extending upward from the fourth lower end portion to the fourth upper end portion, the fourth hat body having a fourth hollow interior above the fourth lower end portion, a fourth illumination system including a fourth light source, the fourth light source being supported by the fourth hat body, the fourth light source being arranged to illuminate the fourth hollow interior of the fourth hat body, the fourth light source positioned adjacent to the fourth upper end portion and oriented to face downward toward the fourth lower end portion to emit light toward the fourth lower end portion to illuminate the fourth hollow interior, the fourth hat body including at least one fourth section of light-transmissible material configured to permit light from the fourth light source to pass from the fourth hollow interior to the exterior of the fourth hat body to be visible from the exterior of the fourth hat body, wherein the first, second, third and fourth hats are in a nested configuration such that the second hat is nested in the first hollow interior of the first hat, the third hat is nested in the second hollow interior of the second hat, and the fourth hat is nested in the third hollow interior of the third hat, and wherein a portion of the fourth hat is disposed in the first hollow interior of the first hat.

15. A hat for a head of a person, the hat comprising:

a cone-shaped hat body having opposite upper and lower end portions, the lower end portion being wider than the upper end portion, the upper end portion forming a tip of the cone-shaped hat body, the lower end portion configured to rest on the head of the person, the hat body extending upward from the lower end portion to the upper end portion, the hat body having a cone-shaped hollow interior above the lower end portion, the lower end portion having an opening for receiving a portion of the head of the person, an illumination system including a light source and a switch configured to turn the light source on, the light source being supported by the hat body, the light source being arranged to illuminate the hollow interior of the hat body, the light source mounted in the hollow interior at the tip and oriented to face downward toward the lower end portion to emit light toward the lower end portion to illuminate the hollow interior, the switch including an actuator disposed above the lower end portion and adjacent the upper end portion, the switch configured to be actuated by the person to turn the light source on, at least a portion of the hat body being formed of a light-transmissible material configured to permit light from the light source to pass from the hollow interior to the exterior of the hat body to be visible from the exterior of the hat body, wherein the light source is in open communication with the opening, and the light source is arranged with respect to the opening, such that the light emitted by the light source reaches the opening and illuminates a majority of the portion of the head of the person when the hat is on the head of the person and the light source illuminates the hollow interior.

16. A hat as set forth in claim 15, wherein the light source includes a housing carrying a light emitting element, and wherein the housing carries the actuator.

* * * * *